United States Patent [19]

Pauza et al.

[11] Patent Number: 4,838,813

[45] Date of Patent: Jun. 13, 1989

[54] TERMINATOR PLUG WITH ELECTRICAL RESISTOR

[75] Inventors: William V. Pauza, Palmyra; Wilmer L. Sheesley, Dauphin, both of Pa.

[73] Assignee: AMP Incorporated, Harrisburg, Pa.

[21] Appl. No.: 267,742

[22] Filed: Nov. 1, 1988

Related U.S. Application Data

[63] Continuation of Ser. No. 197,785, May 10, 1988, abandoned.

[51] Int. Cl.[4] ..... H01R 13/66; H01P 1/26

[52] U.S. Cl. ..... 439/620; 333/22 R; 338/220

[58] Field of Search ..... 439/620; 333/22 R; 338/220, 230, 243, 271–274, 276

[56] References Cited

U.S. PATENT DOCUMENTS

| | | | |
|---|---|---|---|
| 3,302,159 | 1/1967 | Schumacher | 439/620 |
| 3,573,702 | 4/1971 | O'Keefe | 333/22 |
| 3,784,950 | 1/1974 | Coffman | 338/220 |
| 4,070,751 | 1/1978 | Hogendobler et al. | 29/628 |
| 4,206,963 | 6/1980 | English et al. | 439/581 |

FOREIGN PATENT DOCUMENTS

| | | | |
|---|---|---|---|
| 3416905 | 1/1986 | Fed. Rep. of Germany | 439/620 |
| 6706461 | 11/1967 | Netherlands | 439/621 |

OTHER PUBLICATIONS

"Termination for Higgins Connector," Western Electric Technical Dig. No. 25, Jan. 1972.

*Primary Examiner*—Gary F. Paumen
*Attorney, Agent, or Firm*—Gerald K. Kita

[57] ABSTRACT

A terminator 1 includes, a conductive shell 2, a disc 12 of insulative material having integral rivets 13 passing through the shell 2, a center contact 19 concentrically in the disc 12, a resistor 26 having a forward extending electrical lead 27 connected to the center contact 19 and having a rearward extending electrical lead 28 passing through the shell 2, and the shell 2 is overlapped and engaged by the rivets 13 and by the rearward extending electrical lead 28.

7 Claims, 2 Drawing Sheets

TERMINATOR PLUG WITH ELECTRICAL RESISTOR

This application is a continuation of application Ser. No. 197,785, filed May 10, 1988, now abandoned.

FIELD OF THE INVENTION

The specification describes a terminator in the form of an electrical plug for connection to an unused coaxial port of a multiport data transmission apparatus, for example, a multiport transceiver or repeater.

BACKGROUND OF THE INVENTION

A known electrical plug is disclosed in U.S. Pat. No. 4,010,538 and includes a conductive center contact, an insulative disc concentrically encircling the center contact, and a conductive outer shell concentrically encircling the disc.

In the known electrical plug, a rear end of the center contact connects to a center conductor of a coaxial cable shell, a rear end of the shell connects to a ground conductor of the coaxial cable.

SUMMARY OF THE INVENTION

In a coaxial multiport apparatus such as a multiport transceiver or multiport repeater, an electrical signal is supplied to all the ports. Work stations are connected by coaxial cables to corresponding ports. The work stations represent electrical loads connected to the corresponding ports. To achieve balanced line losses at the ports, each unused port requires a terminator with a corresponding load for dissipating the electrical signal to a grounded connection.

According to the invention, a coaxial terminator for connection to an unused port of a multiport apparatus, includes a resistance measured in Ohms, such that the signal transmitting portion of the port is connected throught the resistance to ground electrical potential. A low cost of manufacture of the terminator is of primary consideration, and is achieved by the construction and assembly of parts comprising the coaxial terminator according to the invention.

The construction and assembly of parts of the terminator includes, a conductive shell, a disc of insulative material having integral rivets passing through the shell, a center contact anchored concentrically in the disc, a resistor having a forward extending electrical lead connected to the center contact, and having a rearward extending electrical lead passing through the shell, and the shell is overlapped and engaged by the rivets and by the rearward extending electrical lead to complete a low cost assembly. The invention will be described by way of example with reference to accompanying drawings.

DESCRIPTION OF THE DRAWINGS

With reference to FIGS. 1 and 2 of the drawings, a terminator 1 includes an outer shell 2 having a conductive metal portion formed, for example, by drawing a flat blank of metal such as brass into a cylindrical form having a stepped outer diameter and an open front end 3 and a closed rear end 4. Prior to being drawn the blank includes a series of slits 5 for communicating with the front end 3 of the shell 2 and extending axially of a cylidrical front portion 6 of the shell. Resilient and circumferentially spaced apart fingers 7 are defined between corresponding slits 5 thereby for resilient radially outward expansion of the shell 2 upon connection of the shell 2 to a mating jack or port, not shown. Further, prior to being drawn, the thickness of the blank is bulged outward to provide projecting detents 8 radially inward of the cylindrical front end 3 of the shell 2. Further, prior to being drawn, the blank is provided with a series of apertures 9 for extending through a transverse wall 10 of the shell 2 at a step in the diameter of the shell 2. Further, prior to being drawn, the blank is provided with an opening 11 extending axially of the rear end 4 of the shell 2.

Figure 1:
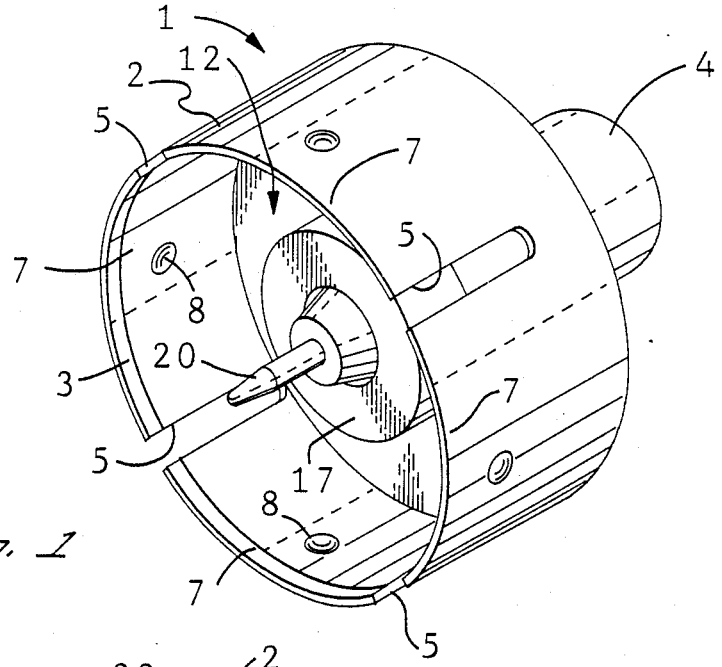
FIG. 1 is a perspective view of a terminator.
Figure 3:
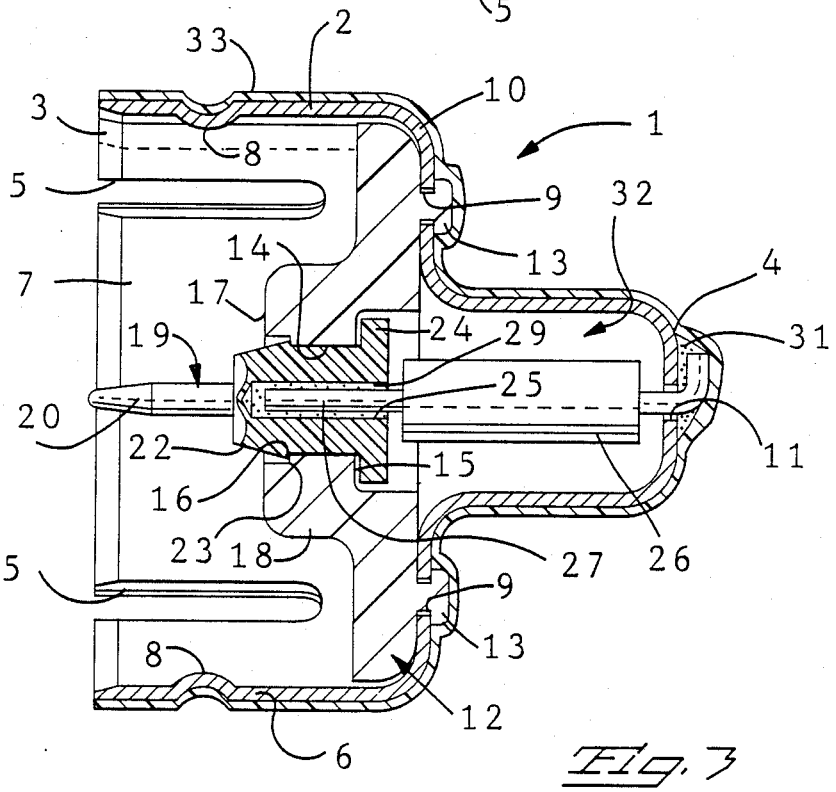
FIG. 3 is an elevation view in section of the terminator.
Figure 2:
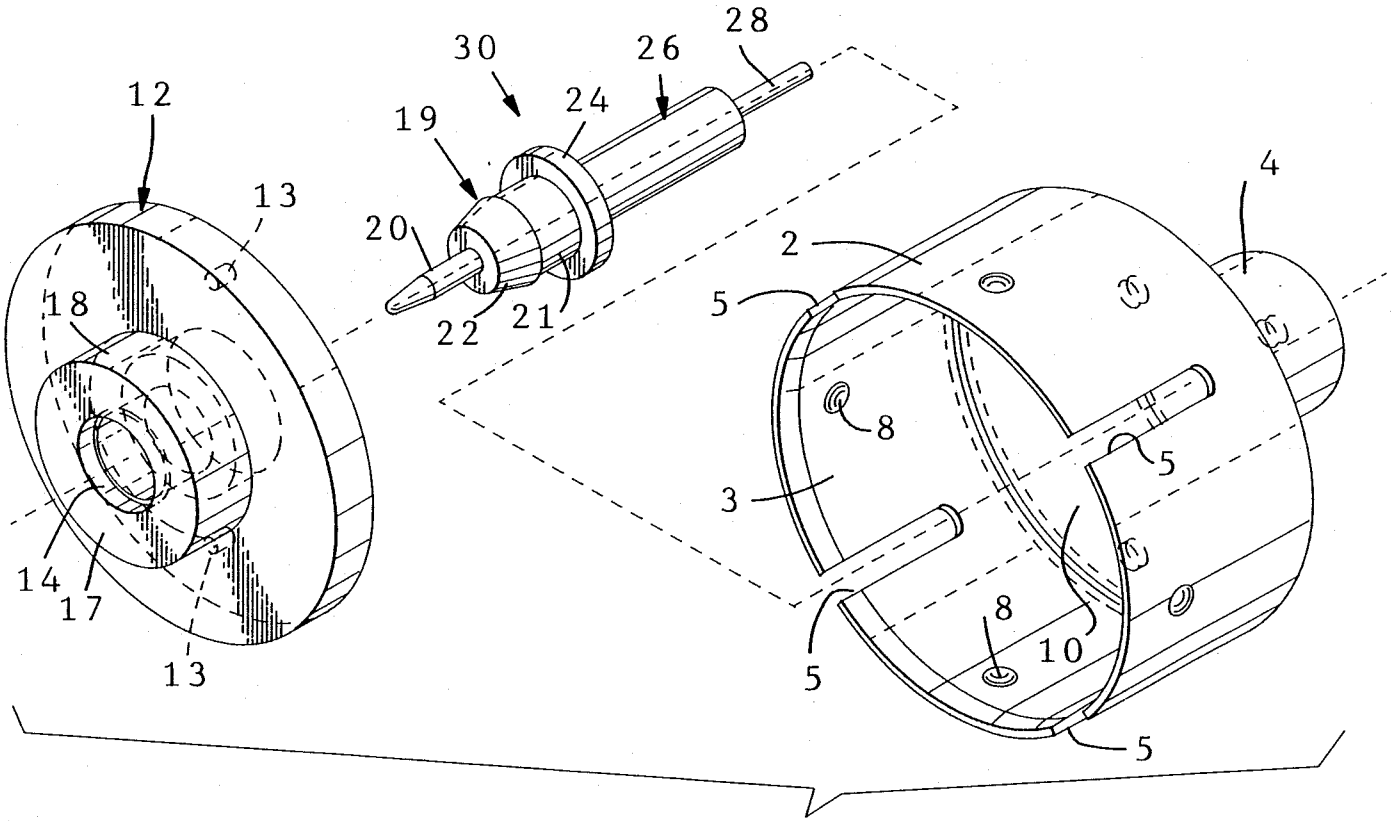
FIG. 2 is a perspective view of the terminator with parts in exploded configuration.

An insulative unitary disc 12 includes axially extending and headless rivets 13 aligned for passage through corresponding apertures 9 of the shell 2. The disc 12 includes a central and axial passageway 14 of stepped diameter to provide a rear facing and recessed annular shoulder 15 and a front facing and recesses annular shoulder 16. A front end 17 of the disc 12 projects forwardly at the end of a cylindrical hub 18.

A conductive center 19 includes a cylindrical pin type electrical contact 20 at a front end integral with an enlarged diameter central portion 21 having a frustoconical front 22 immediately adjacent to a rear facing and radially outward projecting shoulder 23. An integral and outwardly projecting radial flange 24 is at the rear end of the center contact 19. The flange 24 has a concentric cavity 25 that extends from the rear end and forwardly along the central portion 22.

An electrical resistor 26 of selected resistance, for example, 50 Ohms, and of conventional construction, is elongate cylindrical with a forwardly extending and conductive electrical lead 27 and a rearwardly extending and conductive electrical lead 28.

The forwardly extending electrical lead 27 is assembled along the cavity 25 of the center contact 19 and is connected to the center contact 19 by a solder joint 29, formed by a known procedure of heating the parts to be joined or connected, followed by the application of solder heated to a molten state and then solidified upon cooling to ambient temperature. An assembly 30 of the center contact 19 and the resistor 26 are assembled in the rear end of the passageway 14 of the disc 12, with the frustoconical portion 22 of the center contact 19 forcibly traversing the constricted passageway 14. The contact 20 emerges at the front end 17. The rear facing shoulder 23 of the center contact 19 opposes the front facing shoulder 16 of the disc 12 and the flange 24 opposes the rear facing shoulder 15 of the passageway 14, thereby resisting movement of the center contact 19.

The shell 2 is assembled to an assembly of the resistor 26, the center contact 19 and the disc 12. The rear extending electrical lead 28 is assembled through the opening 11 of the shell 2, is bent transversely to overlap and engage the end 4 of the shell 2 and is connected or joined by a conventionally formed solder joint 31. The disc 12 registers against the transverse wall 10 of the shell 2. The rivets 13 extend through corresponding apertures 9 and are spread outwardly to engage and overlap a rear of the transverse wall 10. The rivets 13 are spread outwardly upon the application of sufficient force to cause deformation of the rivets 13 to their outwardly spread condition. The resistor 26 extends within an air space 32 and concentrically within the shell 2, thereby achieving at low cost a resistor 26 protected by the encircling shell 2 and achieving an electrical isolation of the resistor 26 by the encircling air space 32. Movement of the resistor 26 and the center contact 19 while extending axially between the disc 12 and the rear 4 of the shell 2 is resisted by the disc 12 at the front and by the shell 2 at the rear.

The shell 2 includes an external coating 33 of insulative plastic or conductive plastic, adhered to the external surface of the shell 2, the rear extending electrical lead 28 and the rivets 13 of the disc 12. For example, the coating 33 is formed at low cost by dipping the terminator 1 into a pool of unpolymerized plastic monomer to which a copolymer has been added, followed by removing the shell 2 from the pool with the coating 33 adhered. Polymerization of the coating 33 occurs after the terminator 1 has been removed from the pool.

We claim:

1. A terminator comprising, a conductive shell, a disc of insulative material having rivets unitary therewith and passing through the shell, a center contact anchored concentrically in the disc, a resistor having forwardly extending electrical lead connected to the center contact and having a rearwardly extending electrical lead passing through the shell, and the shell is overlapped and engaged by the rivets and by the rearwardly extending electrical lead.

2. A terminator as recited in claim 1, wherein the shell includes an external plastic coating adhered to the rivets and the rearwardly extending electrical lead.

3. A terminator as recited in claim 1, wherein the resistor extends in an air space and concentrically within the shell.

4. A terminator as recited in claim 1, wherein the resistor and the center contact extend concentrically of the shell, and said resistor extends axially between the rear of the shell and the disc.

5. A terminator as recited in claim 1, wherein the resistor and the center contact extend concentrically of the shell, and said resistor extends axially between the rear of the shell and the disc.

6. A terminator comprising: a conductive shell, a disc of insulative material having means unitary therewith and in engagement against a transverse wall of the shell, a resistor having a forwardly extending electrical lead connected to a center contact and having a rearwardly extending electrical lead passing through the shell, the shell being overlapped and engaged by the rearwardly extending electrical lead, the rearward extending lead being joined to the shell by a solder joint, the resistor being encircled by the shell and extending concentrically within the shell, and the resistor being encircled by an air space within the shell to achieve electrical isolation of the resistor.

7. A terminator as recited in claim 6, wherein the shell includes an external plastic coating adhered to the rearward extending lead and the solder joint.

* * * * *